United States Patent [19]

Bransky et al.

[11] Patent Number: 5,007,090

[45] Date of Patent: Apr. 9, 1991

[54] PROGRAMMING DEVICE FOR HEARING AIDS AND/OR HEARING AID COMPONENTS

[75] Inventors: Olaf Bransky; Guenter Wiede, both of Erlangen; Fritz-Dieter Stein; Gerhard Helmreich, both of Effeltrich, all of Fed. Rep. of Germany

[73] Assignee: Siemens Aktiengesellschaft, Berlin and Munich, Fed. Rep. of Germany

[21] Appl. No.: 418,255

[22] Filed: Oct. 6, 1989

[30] Foreign Application Priority Data

Oct. 13, 1988 [DE] Fed. Rep. of Germany ... 8812896[U]

[51] Int. Cl.[5] ..... H04R 29/00

[52] U.S. Cl. ..... 381/60; 381/68.2; 128/746

[58] Field of Search ..... 381/68.2, 68.4, 60; 128/746

[56] References Cited

FOREIGN PATENT DOCUMENTS 0163775 12/1985 European Pat. Off. .

0180428 5/1986 European Pat. Off. .

OTHER PUBLICATIONS

"The Meaning of Digital Technology," Widin, Hearing Instruments, vol. 38, No. 11, 1987 (pp. 28, 30, 32, 33 and 74).

Brochure for PHOX Programming Device Manufactured by Micro-technik.

Radio Shack Catalog 1988 (Aug. 1987), pp. 166-167, Tandy 200 Portable Computer, PC-6, PC-7, PC-8.

*Primary Examiner*—Forester W. Isen

*Attorney, Agent, or Firm*—Hill, Van Santen, Steadman & Simpson

[57] ABSTRACT

A programming device includes a housing for a control unit, a display tablet and a keyboard. Surface-flush integration into a piece of furniture is provided utilizing a housing of a trough-shaped bottom portion with a horizontal cover plate and a wedge-shaped display panel arranged thereon. The housing includes a number of plug-in locations for the acceptance of program modules.

10 Claims, 2 Drawing Sheets

PROGRAMMING DEVICE FOR HEARING AIDS AND/OR HEARING AID COMPONENTS

BACKGROUND OF THE INVENTION

1. Field of the Invention

The present invention relates generally to programming devices for hearing aids.

2. Description of the Prior Art

Known programming devices for hearing aids have a cuboid housing with an obliquely placed surface on which display and control elements are situated. Such a programming device is PHOX of micro-technik GmbH, Stuttgart. However, none of these devices are designed for mounting or the easy acceptance of program modules.

SUMMARY OF THE INVENTION

An object of the present invention is to provide a programming device for hearing aids and hearing aid components that are suitable for programming devices and components of various manufacturers.

Another object of the invention is to design a programming device that it is suitable for a surface-flush integration into a piece of furniture such as a table, console, wall holder or into a wall niche.

The above objects are achieved in a programming device constructed in accordance with the present invention. The programming device includes a housing for a control unit, a display tablet and a keyboard or the like, so at least two plug-in locations for the acceptance of program modules are provided in the housing.

The inventive housing of the programming device is designed to have a trough-shaped bottom portion that can, for example, be inserted into a recess of a table top, so the projecting edge of the cover plate is either supported on the cut-out of the table top or sits in the table top flush with the surface. In this built-in position, the cover plate is situated in the plane of the table top. The integration of the housing is promoted by angled edges of the trough-shaped portion. The trough-shaped bottom portion can accept the electronics of the device and the like. When plug jacks or the like are built into the backside of the trough, the backside wall is vertical instead of angled. Moreover, by utilizing an adjustment foot (or pivotal support leg), the entire housing can be placed at an angle so the display field can be read better. A foil keyboard or a mechanical keyboard or control elements (joy sticks, potentiometers or the like) are incorporated into the operating surface. It is advantageous for reading the display when the display panel is designed in the form of a wedge.

Hearing aids or, respectively, hearing air components of various manufacturers can be programmed with the programming device of the invention. To that end, the housing includes a plurality of plug-in locations into which program modules can be introduced, so that the compatibility of the programming device for hearing aids/components of various manufacturers is guaranteed.

DESCRIPTION OF THE DRAWINGS

FIG. 2 is a perspective view of the programming device of FIG. 1, with program modules and plug-in locations covered by a profile ledge;

DETAILED DESCRIPTION OF THE DRAWINGS

Figure 1:
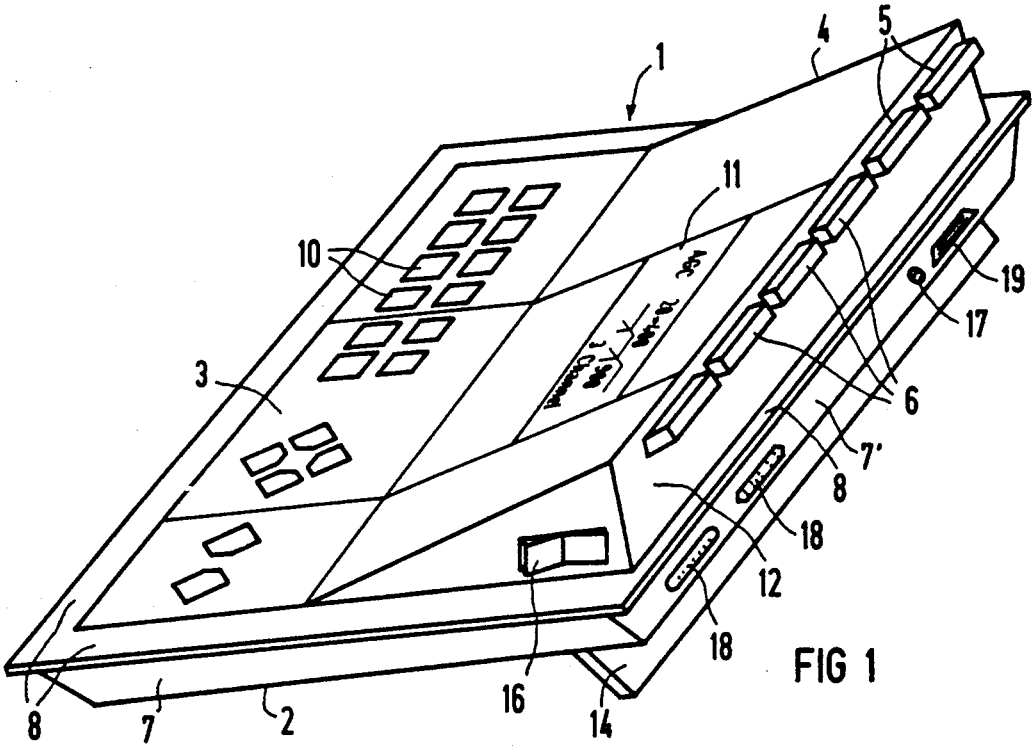
Figure 2:
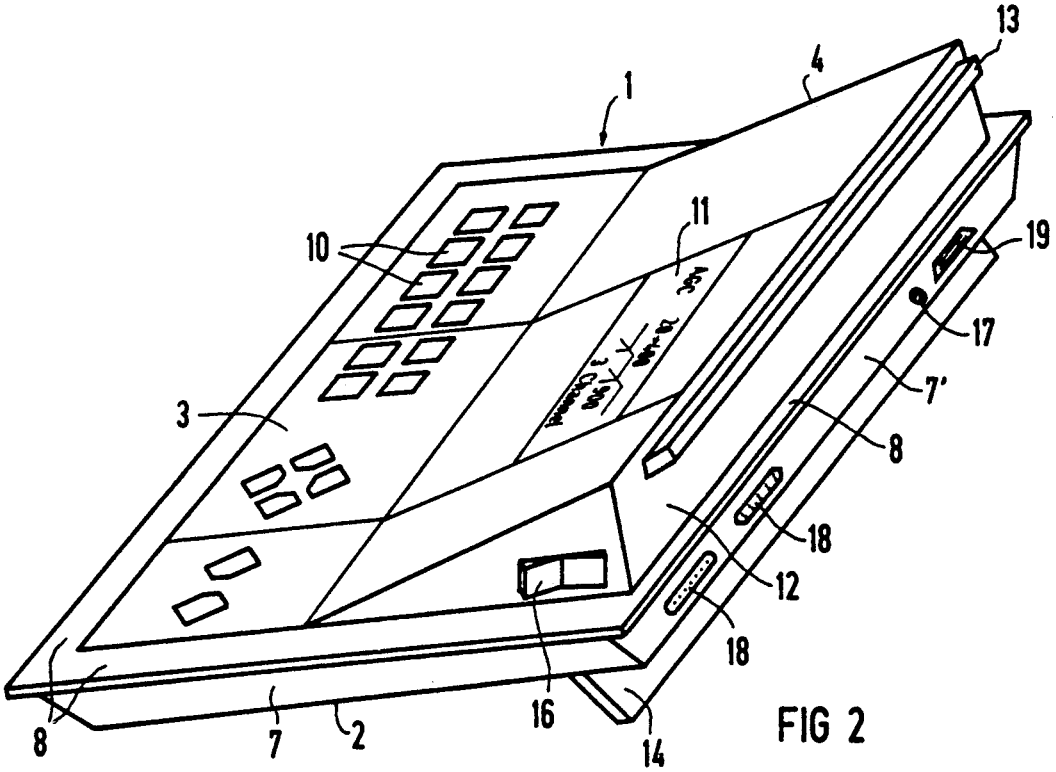
FIG. 2 is a perspective view of the programming device of the present invention.
Figure 3:
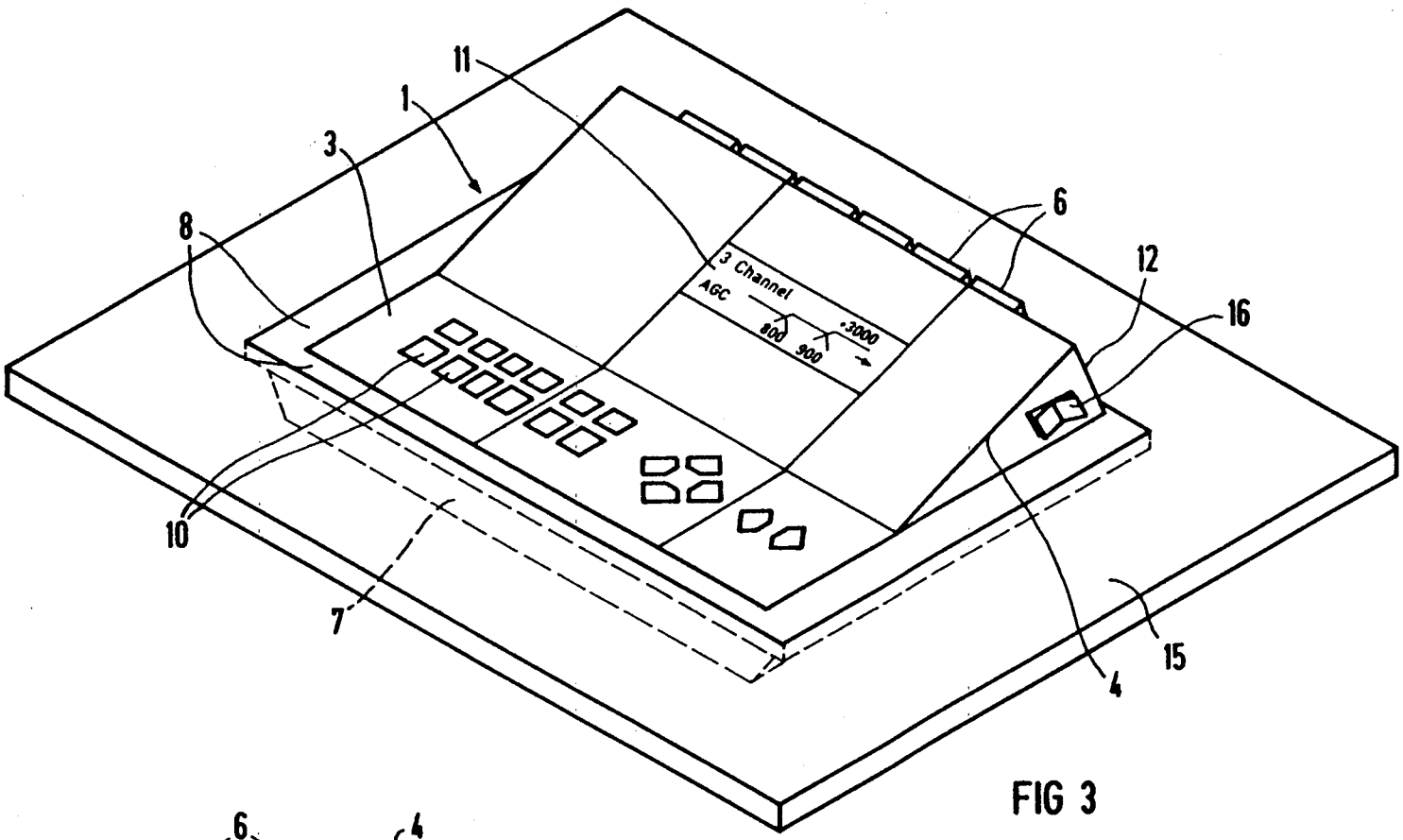
FIG. 3 is a perspective view of the programming device of the invention arranged flush with the surface of a planar wall.

In FIG. 1, the housing 1 of the programming device can be formed of two housing parts, a trough-shaped bottom part 2 that, for example, accepts the integrated components of the device such as the electronics and the like, and an upper part formed of a cover plate 3 and a display panel 4. Relative to the bottom part, the cover plate forms an edge 8 that horizontally protrudes beyond the trough-shaped bottom part 2. As in FIG. 2, it can be introduced into a console, a furniture top, or a table top 15 flush with the surface. The trough side wall 7, between the trough floor 9 and the cover plate 3 is preferably oblique. If main plug 19, terminal 17 for a hearing aid or a hearing aid component or interfaces 18 for the connection of a printer or the like are arranged in the a side wall 7' of the trough portion 2, then this side wall can be perpendicular to the plane of the cover plate.

Figure 4:
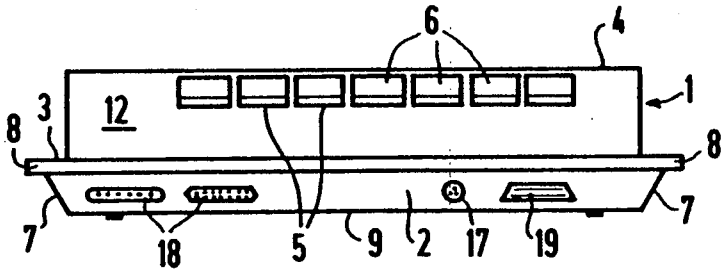
FIG. 4 is a rear view of the programming device of FIG. 1.

In FIG. 4, a number of plug-in locations 5 for the acceptance of program modules 6, are provided in the rear wall 12 of the wedge-shaped display panel 4 adjacent to cover plate 3. The compatibility of the programming device with the various hearing aids/components to be programmed is accomplished through use of program modules 6.

The easily readable LC display 11 at the oblique side of the wedge-shaped display panel 4 and the keyfield 10, provided in the cover plate 3, particularly a foil keyboard, are coated by a foil or the like. As in FIG. 2, a profile ledge 13, that can be plugged on, serves for protection and to prevent contamination of the plug-in locations 5 or the program modules 6. A pivotable support 14 is hinged to the housing 1 for a more pronounced oblique positioning of the display panel 3 and the entire programming device. A toggle switch 16 is provided for switching the programming device on and off.

Although modifications and changes may be suggested by those skilled in the art, it is the intention of the inventors to embody within the patent warranted hereon, all changes and modifications reasonably and properly come within the contribution to the art.

We claim as our invention:

1. A programming device for hearing aids and hearing aid components, comprising;

a trough-shaped housing portion for containing said hearing aid components having a top open end having outer edges;

a cover plate arranged horizontally so as to cover said top open end, said cover plate having outer edges extending beyond said outer edges of said top open end of said trough-shaped housing portion;

a keyboard arrangement situated in a front portion of said cover plate;

a wedge-shaped display panel situated directly on a rear portion of said cover plate with an oblique top side inclined up and away from said front portion; and at least two plug-in locations in a rear wall of said wedge-shaped display panel for receiving hearing aid program modules.

2. A programming device as claimed in claim 1, wherein said trough-shaped housing portion has sidewalls inwardly inclined relative to said cover plate.

3. A programming device as claimed in claim 1, wherein said trough-shaped housing portion has sidewalls inwardly inclined relative to said cover plate and at least one sidewall perpendicular to said cover plate.

4. A programming device as claimed in claim 1, wherein said keyboard arrangement is a foil keyboard.

5. A programming device as claimed in claim 1, wherein said wedge-shaped display panel comprises a liquid crystal display.

6. A programming device as claimed in claim 1, further comprising a protective cover arranged over at least one of said at least two plug-in locations.

7. A programming device as claimed in claim 1, further comprising a pivotable support leg positioned below said trough-shaped housing in an area beneath said rear portion of said cover plate.

8. A programming device as claimed in claim 1, wherein said cover plate and said wedge-shaped display panel form a single integrated member.

9. A programming device as claimed in claim 3, further comprising plug-in locations situated in said side walls perpendicular to said cover plate for receiving hearing aid components.

10. A programming device as claimed in claim 1 further comprising a toggle switch, for turning said programming device on and off, situated in a side wall of said wedge-shaped display panel.

* * * * *